US006234404B1

(12) United States Patent
Cooke

(10) Patent No.: US 6,234,404 B1
(45) Date of Patent: May 22, 2001

(54) FUEL INJECTOR

(75) Inventor: Michael Peter Cooke, Gillingham (GB)

(73) Assignee: Lucas Industries plc (GB)

( * ) Notice: Subject to any disclaimer, the term of this patent is extended or adjusted under 35 U.S.C. 154(b) by 0 days.

(21) Appl. No.: 09/416,350

(22) Filed: Oct. 12, 1999

(30) Foreign Application Priority Data

Oct. 22, 1998 (GB) ..... 9823028

(51) Int. Cl.[7] ..... F02M 47/02
(52) U.S. Cl. ..... 239/88; 239/533.9; 423/446
(58) Field of Search ..... 239/88, 89, 90, 239/91, 92, 533.2, 533.12, 585.1–585.5; 123/446

(56) References Cited

U.S. PATENT DOCUMENTS 4,370,583 * 1/1983 Ljung ..... 310/331
4,579,283 4/1986 Igashira et al. .
4,725,002 2/1988 Trachte .
4,784,102 * 11/1988 Igashira et al. ..... 123/447
4,907,748 * 3/1990 Gardner et al. ..... 239/534
4,909,440 * 3/1990 Mitsuyasu et al. ..... 239/533.9
5,651,345 * 7/1997 Miller et al. ..... 123/446
5,697,554 * 12/1997 Anwaerter et al. ..... 239/88
5,875,764 * 3/1999 Kappel et al. ..... 123/467

FOREIGN PATENT DOCUMENTS 1 751 543 8/1970 (DE) .
0 324 905 7/1989 (EP) .

* cited by examiner

*Primary Examiner*—David A. Scherbel
*Assistant Examiner*—Dinh Q. Nguyen
(74) *Attorney, Agent, or Firm*—Andrus, Sceales, Starke & Sawall

(57) ABSTRACT

A fuel injector comprising a fuel inlet arranged, in use, to receive fuel under high pressure from a source of pressurised fuel, an outlet and an accumulator volume located between the inlet and the outlet. A piezoelectric actuator is located within the accumulator volume and is operable to move a control piston to modify the fuel pressure within a control chamber.

13 Claims, 3 Drawing Sheets

FUEL INJECTOR

FIELD OF THE INVENTION

This invention relates to a fuel injector for use in the delivery of fuel to a combustion space of an internal combustion engine. In particular, the invention relates to a fuel injector of the type intended for use in a fuel system of the accumulator or common rail type, the injector being of the type controlled using a piezoelectric actuator.

BACKGROUND OF THE INVENTION

In a known piezoelectrically actuated fuel injector, a piezoelectric actuator is operable to control the position occupied by a control piston, the piston being moveable to control the fuel pressure within a control chamber defined, in part, by a surface associated with the valve needle of the injector to control movement of the injector. Such an arrangement suffers from the disadvantage that fuel tends to leak from the control chamber past the piston, such a parasitic escape of fuel resulting in the injector being relatively inefficient. Further, during injection, the restriction to fuel flow formed by the passages and fuel lines whereby the injector is connected to a common rail may result in the fuel injection pressure falling to an unacceptable level.

Another problem with known injectors is that pressure waves transmitted along the fuel passages and lines may give rise to undesirable needle movement during injection and may be of sufficient magnitude to cause secondary injections.

SUMMARY OF THE INVENTION

It is an object of the invention to provide a fuel injector in which the disadvantageous effects described hereinbefore are of reduced effect.

According to the present invention there is provided a piezoelectrically actuable fuel injector comprising a fuel inlet arranged, in use, to receive fuel under high pressure from a source of pressurized fuel, an outlet, and an accumulator volume located between the inlet and the outlet, a piezoelectric actuator being located within the accumulator volume and being operable to move a control piston to modify the fuel pressure within a control chamber.

Such an arrangement is advantageous in that the end of the control piston remote from the control chamber may be exposed to fuel at high pressure. The fuel pressure drop along the length of the piston may therefore be reduced, and as a result leakage of fuel from the control chamber can be reduced. Further, it will be appreciated that by providing the injector with such an accumulator volume, depending upon the capacity of the accumulator volume, the effect of the fall in fuel pressure due to the fuel passages and lines upstream of the fuel inlet can be reduced.

An articulated connection is conveniently provided between the actuator and the control piston. Such an arrangement permits compensation for slight manufacturing inaccuracies. The articulated connection is conveniently arranged to permit the application of a retracting force to the piston upon energizing the actuator in such a manner as to reduce the length thereof. This is conveniently achieved by arranging for a seal to be formed between the actuator and the piston such that, upon the length of the actuator being reduced, a partial vacuum is drawn in a volume between the actuator and the piston serving to draw the piston to follow the movement of the end of the actuator.

The volume between the piston and the actuator may communicate with the control chamber, if desired.

The actuator is conveniently provided with a flexible sealant coating, preferably an electronics conformal sealant coating. The provision of such a coating reduces the risk of damage to the actuator due to the application of fuel under high pressure thereto. The fuel pressure acting upon the actuator further keeps the stack under compression which reduces the risk of propagation of cracks in the actuator.

BRIEF DESCRIPTION OF THE DRAWINGS

The invention will be described, by way of example, with reference to the accompanying drawings, in which.

DETAILED DESCRIPTION OF THE PREFERRED EMBODIMENT

Figure 1:
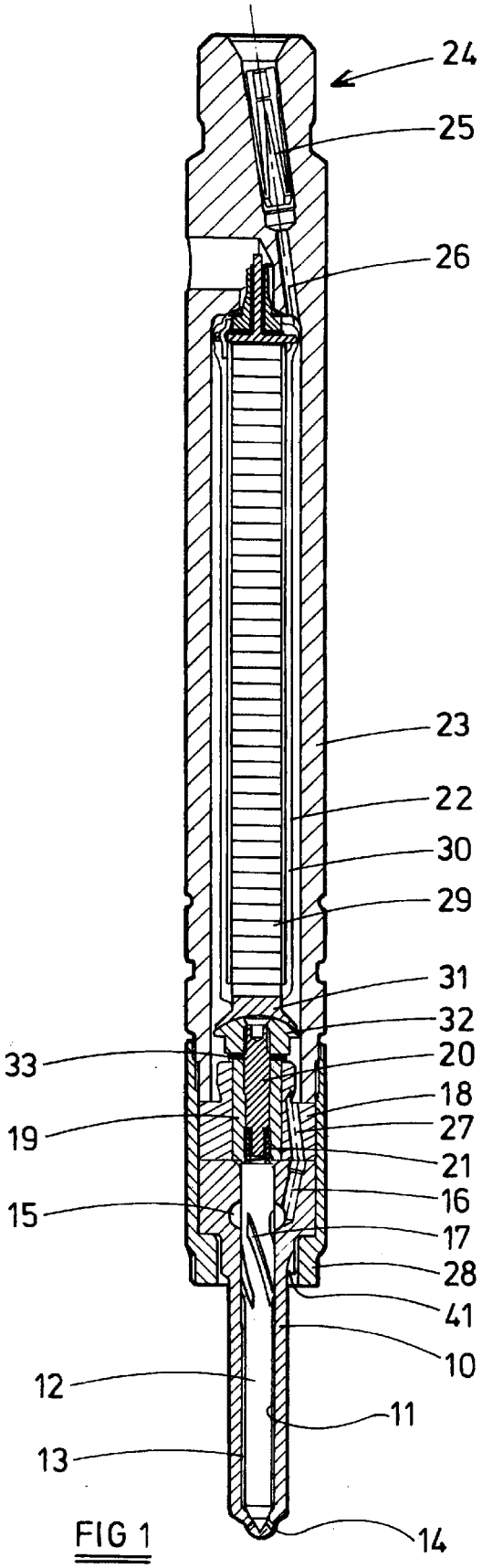
FIG. 1 is a sectional view illustrating a fuel injector in accordance with an embodiment of the invention.

The fuel injector illustrated in the accompanying drawings comprises a nozzle body 10 provided with a blind bore 11 within which a valve needle 12 is reciprocable. The valve needle 12 is shaped for engagement with a seating defined adjacent the blind end of the bore 11. The needle 12 is of stepped form, including a relatively large diameter region which is of diameter substantially equal to that of the adjacent part of the bore 11 and arranged to guide the needle 12 for sliding movement within the bore 11, and a reduced diameter portion which defines, with the bore 11, a delivery chamber 13. It will be appreciated that engagement of the needle 12 with the seating controls communication between the delivery chamber 13 and one or more outlets openings 14 located downstream of the seating.

The bore 11 is shaped to define an annular gallery 15 which communicates with a drilling 16 provided in the nozzle body. The needle 12 is provided with flutes 17 defining flow paths between the annular gallery 15 and the delivery chamber 13. The needle 12 defines an angled step at the interconnection of the relatively large and smaller diameter regions thereof, the step forming a thrust surface which is exposed to the fuel pressure within the delivery chamber 13 such that when fuel under high pressure is applied to the delivery chamber 13, the action of the fuel applies a force to the needle 12 urging the needle 12 away from its seating. The exposed end surface of the needle 12 similarly forms a thrust surface against which fuel under pressure may act to urge the needle towards its seating.

The nozzle body 10 abuts a distance piece 18 provided with a through bore within which a piston member 19 of tubular form is slidable. A screw-threaded rod 20 is engaged within the passage defined by the tubular piston member, a spring 21 being engaged between the screw-threaded rod 20 and the end surface of the valve needle 12. The spring 21 applies a biasing force to the needle 12, urging the needle 12 towards its seating. It will be appreciated that for a given position of the piston member 19, adjustment of the axial position of the screw-threaded rod 20 by rotating the rod 20 relative to the piston member 19 will vary the spring force applied by the spring 21 to the needle 12.

The distance piece 18 abuts an end of an actuator housing 23 which is of elongate form and is provided with a bore defining an accumulator 22. The actuator housing 23 is provided with an inlet region 24 arranged to be coupled to a high pressure fuel line (not shown) to permit connection of the fuel injector to a source of fuel under high pressure, for example a common rail charged to an appropriate high pressure by a suitable high pressure fuel pump. The inlet region 24 houses an edge filter member 25 to remove particulate contaminants from the flow of fuel to the injector, in use, thereby reducing the risk of damage to the various components of the injector. The clean side of the filter formed by the edge filter member 25 communicates through a drilling 26 with the accumulator 22. A drilling 27 provided in the distance piece 18 permits communication between the accumulator 22 and the drilling 16 provided in the nozzle body 10. A cap nut 28 is used to secure the nozzle body 10 and distance piece 18 to the actuator housing 23.

A piezoelectric actuator stack 29 is located within the accumulator 22. The actuator stack 29 may be provided with a coating 30 of a flexible sealant material, the sealant material being of an electronics conformal nature. The coating 30 acts to prevent or restrict the ingress of fuel into the joints between the individual elements forming the piezoelectric actuator stack 29, thus reducing the risk of damage to the actuator stack 29. Further, as the stack is subject to the compressive load applied by the fuel under pressure, the risk of propagation of cracks is reduced. The actuator stack 29 carries, at its lower end, an anvil member 31 which is shaped to define a part-spherical recess. A load transmitting member 32 including a region of part-spherical form extends into the part-spherical recess of the anvil member 31. The load transmitting member 32 is provided with an axially extending, screw-threaded passage within which the screw-threaded rod 20 engages. A spacer or shim 33 is located between the load transmitting member 32 and the adjacent face of the tubular piston member 19 to control the spacing of these components.

The screw threaded rod 20 is shaped to receive a tool for use in rotating the rod 20 to adjust the spring force applied to the needle 12.

The radius of curvature of the part-spherical surface of the load transmitting member 32 is slightly greater than that of the part-spherical recess of the anvil member 31. It will be appreciated, therefore, that the engagement between these components occurs around a substantially circular sealing line adjacent the outer periphery of the anvil member 31, and that a small volume is defined between these components. The cooperation between the anvil member 31 and load transmitting member 32 is such as to define an imperfect seal between these components, the seal being sufficient to restrict the rate at which fuel can flow to the volume defined therebetween from the accumulator 22.

The upper end of the actuator stack 29 is secured to a first terminal member 34 using an appropriate adhesive, an insulating spacer member 35 being located between the first terminal member 34 and the end surface of the actuator stack 29. A second, outer terminal member 36 surrounds a stem 34a of the first terminal member 34, another insulator member 37 being located between the first and second terminal members. Again, a suitable adhesive is conveniently used to secure these integers to one another. A seal member 38 engages around part of the second terminal member 36. The seal member 38 includes a surface of part-spherical or part-spheroidal form which is arranged to seat within a correspondingly shaped recess formed around a drilling which opens into an end of the accumulator 22, to compensate for slight misalignments and manufacturing inaccuracies. The first and second terminals 34, 36 extend into a radial drilling 39 provided in the actuator housing 23 whereby appropriate electrical connections can be made to permit control of the piezoelectric actuator. The fuel pressure within the accumulator assists the adhesive in retaining the various components in position.

The seal member 38 may be constructed from a high performance engineering thermoplastics material such as Poly Ethyl Ether Ketone (PEEK), PPS or LCP, or may be constructed from a ceramic material.

The end surface of the needle 12 which engages the spring 21 is exposed to the fuel pressure within a control chamber 40 defined between the nozzle body 10, the distance piece 18, the piston member 19 and the screw-threaded rod 20. It will be appreciated that the fuel pressure within the control chamber 40 assists the spring 21 in applying a force to the needle 12 urging the needle 12 towards its seating.

In use, with the injector supplied with fuel under high pressure, and with the piezoelectric actuator stack 29 occupying an energization state in which it is of relatively great length, the piston member 19 occupies a position in which the fuel within the control chamber 40 is pressurized to an extent sufficient to ensure that the force applied to the needle 12 by the fuel under pressure within the control chamber 40 in conjunction with the action of the spring 21 is sufficient to hold the needle 12 in engagement with its seating against the action of the fuel under pressure within the delivery chamber 13. It will be appreciated, therefore, that injection of fuel is not taking place. The fuel pressure within the accumulator 22 is high, thus a relatively small pressure drop occurs along the length of the piston member 19. As a result, leakage of fuel between the piston member 19 and the distance piece 18 from the control chamber 40 to the accumulator 22 is restricted to a low level.

Figure 2:
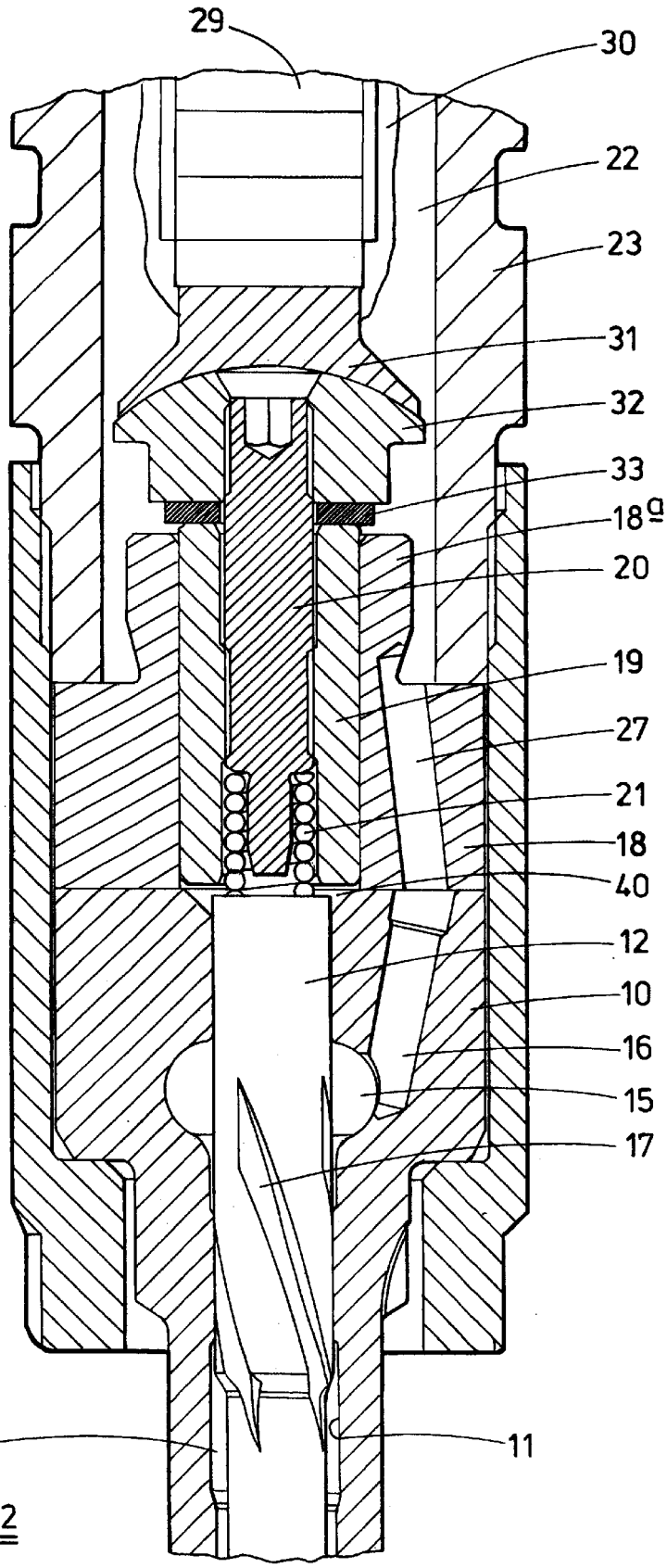
FIGS. 2 and 3 are enlarged views illustrating parts of the injector of FIG. 1.
Figure 3:
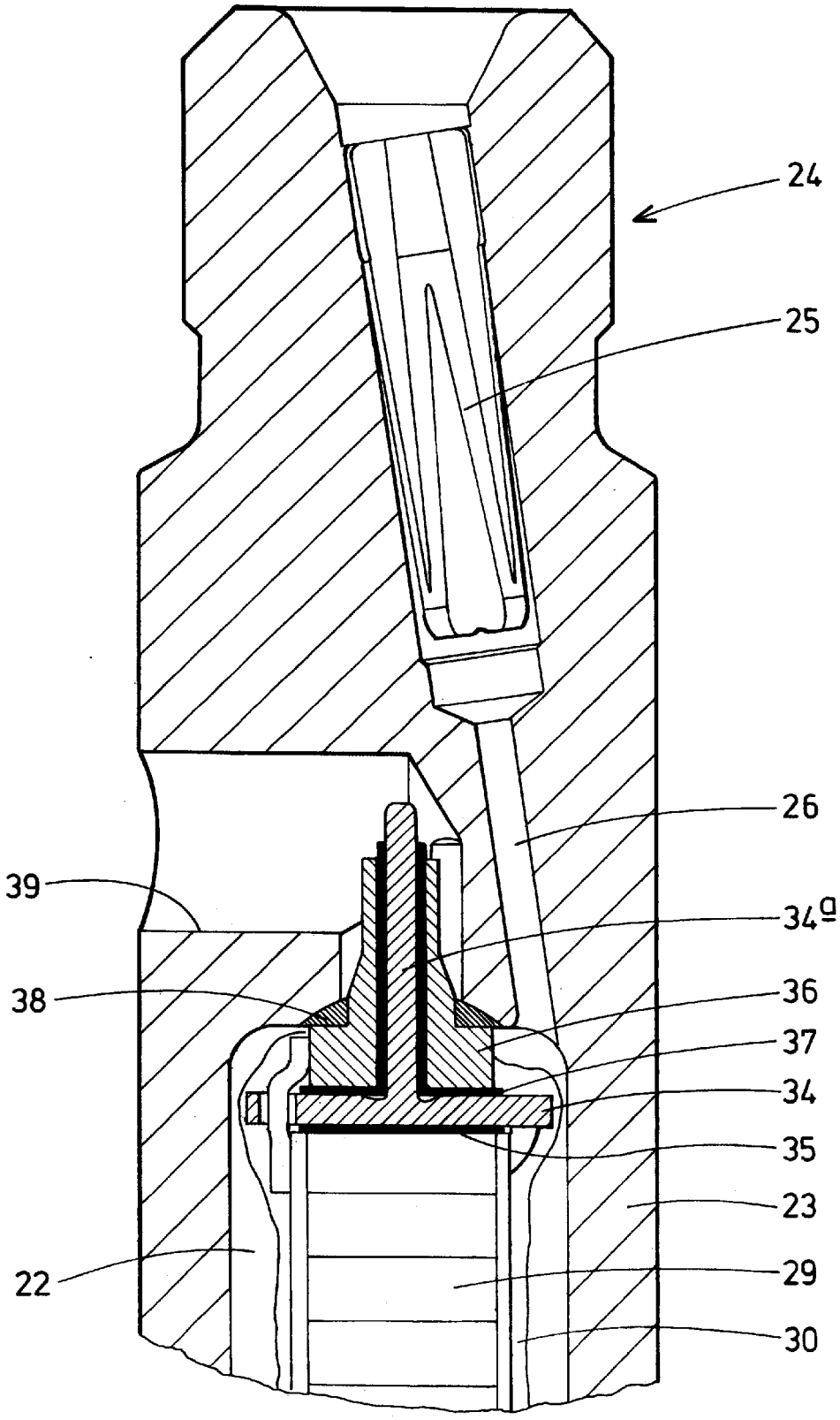

Additionally, as illustrated most clearly in FIG. 2, the distance piece 18 is shaped to include a region 18*a* of reduced diameter which extends into the accumulator 22. The fuel under pressure within the accumulator 22 acts upon the outer surface of this part of the distance piece 18 applying a radial compressive load to the distance piece 18, and a result, leakage of fuel between the piston member 19 and the distance piece 18 is further restricted.

In order to commence injection, the actuator stack 29 is operated to move to a second energization state in which it is of reduced axial length. Since the upper end of the actuator stack 29, in the orientation illustrated, is held in a fixed position relative to the actuator housing 23, the change in energization state of the stack 29 to reduce the length thereof results in upward movement of the lower end of the stack 29. The movement of the lower end of the actuator stack 29 is transmitted to the anvil 31. As a seal is formed between the anvil 31 and the load transmitting member 32, the movement of the anvil member 31 reduces the fuel pressure within the volume defined between these components, the reduced fuel pressure serving to draw the load transmitting member 32 to move with the stack 29. As the control piston member 19 is secured to the load transmitting member 32, the change in energization state of the stack 29 results in movement of the piston member 19, increasing the volume of the control chamber 40, and hence reducing the fuel pressure acting upon the needle 12. As the movement of the piston member 19 continues, the action of the fuel under pressure within the control chamber 40 will reduce to a point beyond which the needle 12 is no longer held in engagement with its seating, and as a result, fuel is able to flow from the delivery chamber 13 to the outlet openings 14, and injection of fuel commences.

When injection is to terminate, the stack 29 is returned to its original energization state, and as a result the anvil 31 and load transmitting member 32 are pushed in a downward direction returning the piston member 19 to substantially its original position. As a result, the fuel pressure within the control chamber 40 increases, thus applying a greater magnitude force to the needle 12, and a point will be reached beyond which the fuel pressure within the control chamber 40 in conjunction with the spring 21 is able to return the needle 12 into engagement with its seating.

The volume between the anvil 31 and the load transmitting member 32 communicates with the control chamber 40, conveniently through the screw-threaded engagement between the piston member 19 and the rod 20, and between the rod 20 and the load transmitting member 32. As a result, during injection, the volume between the anvil 31 and the load transmitting member 32 is held at a relatively low pressure, between the accumulator pressure and the control chamber pressure, the control chamber 40 being at a relatively low pressure, thus any leakage of fuel to the volume from the accumulator 22 is of little effect.

Should the actuator stack 29 fail and the piston member 19 remain in its lifted position for an undesirably long period of time, leakage of fuel at a low rate between the needle 12 and the nozzle body 10 from the annular gallery 15 to the control chamber 40 and/or from the accumulator 22 to the control chamber 40 will eventually pressurize the control chamber 40 to an extent sufficient to return the needle 12 into engagement with its seating and terminate injection. It will therefore be appreciated that the injector is fail-safe. The rate at which such leakage occurs is sufficiently low that normal operation of the injector is not impeded, and where fuel does flow to the control chamber 40 during injection, upon termination of injection the movement of the piston member 19 will force the excess fuel from the control chamber 40 to the accumulator or the annular gallery.

If desired, the communication between the volume defined between the anvil 31 and the load transmitting member 32 and the control chamber 40 may be broken. In this case, during injection, leakage of fuel to the volume from the accumulator 22 will gradually reduce the partial vacuum drawn therebetween, and as a result, if injection is not terminated within a predetermined time, for example upon the failure of the piezoelectric stack 29, then the load transmitting member 32 will separate from the anvil 31, and the fuel pressure within the accumulator 22 will return the piston member 19 to a position in which the fuel pressure within the control chamber 40 is sufficient to return the needle 12 into engagement with its seating. It will be appreciated, therefore, that a second fail-safe may be provided.

The embodiment described hereinbefore is advantageous in that an accumulator is provided between the inlet arrangement 24 and the outlets 14 of the injector. As a result, during injection, as a significant quantity of fuel under high pressure is stored within the accumulator 22 of the injector, the effect of pressure loses resulting from the restriction to flow formed by the high pressure line between the injector and the common rail can be minimised.

A further advantage of the arrangement described hereinbefore is that pressure waves transmitted along the high pressure fuel line, for example reflected waves occurring after termination of injection, will arrive at the delivery chamber 13 very shortly after their transmission to the accumulator 22. As a result, the effect of the pressure waves upon the needle 12 and the piston member 19 urging the piston member 19 in an upward direction in the orientation illustrated will be countered by the effect of the pressure waves within the accumulator 22 urging the piston member 19 in a downward direction to increase the fuel pressure within the control chamber 40. The risk of secondary injection of fuel as a result of the transmission of such reflected waves may thus be reduced.

The injector described hereinbefore is suitable for use in applications in which the injector must be of relatively small diameter. In such applications, the stresses applied to the various components are sufficient that it is not practical to use one or more dowels to ensure that the various components are properly aligned. In order to avoid the use of such dowels, and permit correct orientation of the various components, the nozzle body 10 is conveniently provided with a slot or groove 41 or an alternative identification feature which is accessible once the injector has been assembled to permit determination of the orientation of the nozzle body 10.

What is claimed is:

1. A fuel injector comprising a high pressure fuel inlet arranged, in use, to receive fuel under high pressure from a source of pressurized fuel, an outlet and a piezoelectric actuator which is operable to move a control piston to modify the fuel pressure within a control chamber, said fuel injector further comprising an accumulator volume arranged to receive pressurized fuel from the high pressure fuel inlet, the accumulator volume being located downstream of said high pressure fuel inlet between said high pressure fuel inlet and said outlet, said piezoelectric actuator being located within said accumulator volume.

2. The fuel injector as claimed in claim 1, wherein an articulated connection is provided between said piezoelectric actuator and said control piston.

3. The fuel injector as claimed in claim 2, wherein said articulated connection is arranged to permit the application of a retracting force to said control piston upon energization of said piezoelectric actuator so as to reduce the length thereof.

4. The fuel injector as claimed in claim 3, wherein a seal is formed between said piezoelectric actuator and said control piston such that, upon said length of said piezoelectric actuator being reduced, a partial vacuum is drawn in a volume between said piezoelectric actuator and said control piston, serving to draw said control piston to follow the movement of the end of said piezoelectric actuator.

5. The fuel injector as claimed in claim 4, wherein said piezoelectric actuator carries an anvil member and said control piston carries a load transmitting member, said seal being formed between said anvil member and said load transmitting member.

6. The fuel injector as claimed in claim 4, wherein said volume between said control piston and said piezoelectric actuator is in communication with said control chamber.

7. The fuel injector as claimed in claim 1, wherein said piezoelectric actuator is provided with a flexible sealant coating.

8. The fuel injector as claimed in claim 7, wherein said sealant coating is an electronics conformal sealant coating.

9. A fuel injector comprising a high pressure fuel inlet arranged, in use, to receive fuel under high pressure from a source of pressurized fuel, an outlet and a piezoelectric actuator which is operable to move a control piston to modify the fuel pressure within a control chamber, said fuel injector further comprising an accumulator volume, the accumulator volume being located downstream of the high pressure fuel inlet, between said high pressure fuel inlet and said outlet, said piezoelectric actuator being located within said accumulator volume, wherein an articulated connection is provided between said piezoelectric actuator and said control piston.

10. The fuel injector as claimed in claim 9, wherein said articulated connection is arranged to permit the application of a retracting force to said control piston upon energization of said piezoelectric actuator so as to reduce the length thereof.

11. The fuel injector as claimed in claim 10, wherein a seal is formed between said piezoelectric actuator and said control piston such that, upon said length of said piezoelectric actuator being reduced, a partial vacuum is drawn in a volume between said piezoelectric actuator and said control piston, serving to draw said control piston to follow the movement of the end of said piezoelectric actuator.

12. The fuel injector as claimed in claim 11, wherein said piezoelectric actuator carries an anvil member and said control piston carries a load transmitting member, said seal being formed between said anvil member and said load transmitting member.

13. The fuel injector as claimed in claim 12, wherein said volume between said control piston and said piezoelectric actuator is in communication with said control chamber.

* * * * *